United States Patent [19]

Lee et al.

[11] Patent Number: 4,964,426

[45] Date of Patent: Oct. 23, 1990

[54] TOBACCO SMOKE FILTERS AND PROCESS FOR PRODUCTION THEREOF

[75] Inventors: Benedict M. Lee; James E. Harris, both of Kingsport, Tenn.

[73] Assignee: Eastman Kodak Company, Rochester, N.Y.

[21] Appl. No.: 250,690

[22] Filed: Sep. 28, 1988

[51] Int. Cl.[5] ..... A24D 3/16

[52] U.S. Cl. ..... 131/342; 131/331; 131/341; 131/345

[58] Field of Search ..... 131/342, 331, 345, 341

[56] References Cited

U.S. PATENT DOCUMENTS

| | | | |
|---|---|---|---|
| 683,817 | 2/1969 | Hatfield et al. . | |
| T859,005 | 2/1969 | Hatfield et al. | 131/342 |
| 2,172,946 | 9/1939 | Sutter . | |
| 2,881,770 | 4/1959 | Touey . | |
| 3,101,723 | 8/1963 | Seligman et al. . | |
| 3,251,365 | 5/1966 | Keith et al. . | |
| 3,320,961 | 5/1967 | Hughes et al. . | |
| 3,327,718 | 6/1967 | Kilburn . | |
| 3,340,879 | 9/1987 | Horsewell et al. . | |
| 3,347,247 | 10/1967 | Lloyd . | |
| 3,351,071 | 11/1967 | Belfort | 131/342 |
| 3,417,758 | 12/1968 | Sublett et al. . | |
| 3,424,172 | 1/1969 | Neurath et al. . | |
| 3,424,173 | 1/1969 | Touey et al. . | |
| 3,426,763 | 2/1969 | Sloan et al. | 131/342 |
| 3,428,056 | 2/1969 | Sublett et al. . | |
| 4,763,674 | 8/1988 | Lelah . | |
| 4,765,347 | 8/1988 | Sensabaugh, Jr. et al. . | |
| 4,765,348 | 8/1988 | Honeycutt . | |

FOREIGN PATENT DOCUMENTS

| | | |
|---|---|---|
| 1517320 | 12/1969 | Denmark . |
| 1168354 | 10/1969 | United Kingdom . |
| 2189127A | 10/1987 | United Kingdom . |

OTHER PUBLICATIONS

"Kodak Tobacco Smoke Filter Know-How; Summary of Research Through Jan., 1970", Jul. 1972, Eastman Kodak Company.

Fundaments of High Polymers, O. A. Battista, Reinhold Publishing Corporation, New York, Library of Congress Catalog No. 58-10427.

The Merck Index, pp. 273 and 274.

*Primary Examiner*—V. Millin

*Attorney, Agent, or Firm*—Thomas R. Savitsky; Mark A. Montgomery; William P. Heath, Jr.

[57] ABSTRACT

Disclosed is a novel tobacco smoke filter material comprising a filter element such as cellulose acetate crimped tow having at least about 1 weight percent of micro acicular crystals of a compound such as sodium carbonate present on the surfaces of the filter element. Also disclosed is a process for preparation of such tobacco smoke filter material.

15 Claims, No Drawings

TOBACCO SMOKE FILTERS AND PROCESS FOR PRODUCTION THEREOF

FIELD OF INVENTION

The present invention is directed to a tobacco smoke filter material for increasing filtration efficiency of tar from tobacco smoke and for altering the nicotine to tar ratio of the smoke.

BACKGROUND OF THE INVENTION

It is well known that tobacco smoke contains more than three thousand constituents in the form of liquid-solid or vapor. Cigarette filters commonly used now are made of cellulose acetate, cotton, rayon, or paper. Among these filter materials, over 90% of the filter cigarettes made in the U.S. and a majority of filter cigarettes made in the world use a single-segment cellulose acetate filter. The performance of these filters in terms of pressure drop generation and tar filtration efficiencies are somewhat limited because of certain requirements for cigarette filter. For example, at a filter length of between 15 mm and 30 mm, filter presssure drop is typically between 30 and 120 mm, and filtration efficiency is typically between 25% and 50%. Therefore, to make medium or low tar cigarettes, which requires higher than 50% filtration efficiency, ventilation of the filter tips is commonly used, which adds extra cost for the cigarette manufacturers.

The prior known fibrous filters are capable of removing varying percentages of tar and nicotine from cigarette smoke depending on the amount of fibrous material compacted into them, their length, their circumference, their resistance to draw, the surface characteristics of the fiber, and other factors. These filters, however, show substantially no reverse selectivity for the filtration of nicotine from cigarette smoke, particularly when the tobacco is the conventional type used in cigarettes produced in the United States.

U.S. Pat. Nos. 3,327,718, and 3,340,879 describe cigarette filters consisting of fibrous filter material treated with zeolite and poly(alkyleneimine), respectively, for removing acidic components in the smoke. In these U.S. patents, reverse selective removal of nicotine was not disclosed but it is probable that the removal of acidic components in the smoke would change the pH of the smoke. No. U.S. patent is known which specifically discloses suppressing the filtration of nicotine in cigarette smoke. Another U.S. Pat. No. 3,428,056 describes a filter material incorporated with a polyolefin powder on which inorganic water soluble salts are coated especially the salts such as sodium carbonate, sodium phosphite, potassium carbonate and potassium phosphite. These filter materials were used to improve particulate matter removal and to selectively remove hydrogen cyanide from tabacco smoke. UK patent 2,189,127 discloses polyolefin-containing or cellulose acetate filter substrate treated with sodium bicarbonate, sodium carbonate, potassium permanganate, manganese dioxide, dissolved or dispersed in a nonionic sping solution. Such filter substrates were used to remove undesirable components such as hydrogen cyanide. The present invention relates to filter additives in a certain form which will greatly enchance the filtration efficiency of tobacco smoke filters without increasing the filter pressure drop substantially.

SUMMARY OF THE INVENTION

The present invention is directed to a tobacco smoke filter material comprising a fibrous or sheet tobacco smoke filter element having surfaces for exposure to tobacco smoke, wherein said filter element has micro acicular crystals of a compound present on said surfaces in an amount of at least about 1 weight percent based on the weight of said filter material.

The present invention is also directed to a process for preparing a tobacco smoke filter material comprising the steps of:

(a) immersing a fibrous or sheet tobacco smoke filter element having surfaces for exposure to tobacco smoke in a solution comprising a liquid and about 1 to about 50 weight percent of a compound capable of forming micro acicular crystals, (b) removing the filter element from said solution to result in a filter element in contact with residual solution, and (c) removing the liquid from said residual solution under conditions such that a tobacco smoke filter material is formed comprising said filter element having micro acicular crystals of said compound present on said surfaces in an amount of at least about 1 weight percent based on the weight of said filter material.

DETAILED DESCRIPTION OF THE INVENTION

The compound capable of forming micro acicular crystals useful in the present invention is preferably water soluble, inorganic and non-toxic. Said compound is also preferably a salt and preferably has a molecular weight of less than 1,000. By the term "non-toxic" is meant that the compound is suitable for use as a food additive. The compound also preferably imparts no distinctive odor to tobacco smoke when employed in cigarette filters in accordance with the present invention. Preferred compounds are alkali metal salts or alkaline earth metal salts of inorganic acids, especially sulfates, phosphates, and carbonates. Specific preferred compounds are magnesium sulfate, ammonium phosphate (monobasic) and sodium carbonate, with sodium carbonate being most preferred. The micro acicular crystals formed by the compound of the present invention can be described as being needle-like. Such crystals have a length in excess of width. The average width of the crystals on the surfaces is preferably between about 0.1 and about 5 micrometers ($\mu$m); more preferred is about 0.1 to about 3 $\mu$m. The average length of the crystals on the surfaces is preferably between about 0.2 and about 20 $\mu$m; more preferred is about 0.5 to about 15 $\mu$m.

The liquid of the solution for use in the present invention is preferably water. The preferred aqueous solution for use in the process of the present invention preferably comprises about 1 to 50 weight percent of the micro acicular crystal forming compound, more preferred is about 5 to about 30 weight percent. It is contemplated that any mixture of two or more of such compounds may be employed.

The tobacco smoke filter material of the present invention preferably has between about 1 and about 50 weight percent of micro acicular crystals. More preferred is between about 5 and 30 weight percent. Most preferred is between about 5 and 20 weight percent, based on the weight of the filter material.

The tobacco smoke filter element for use in the present invention is either in the form of fibers or sheets; preferred is fibers. Fibers useful in the present invention can be any fibers useful in the tobacco industry for filtering tobacco smoke. For example, such fibers can be comprised of cellulose acetate, regenerated cellulose, polyolefine such as polypropylene, cotton and the like. Paper is typically in the form of crimped sheets. More preferred fibers are comprised of cellulose acetate.

The fibers or sheets for use as a starting material for the process of the present invention can be of most any physical form. For example, the fibers can be a mass in the form of filter rods or as crimped or uncrimped tow useful for forming filter rods. Preferred is crimped tow. The tobacco smoke filter material of the present invention can be easily formed into tobacco filters such as cigarette filters and fabricated into a filter cigarette.

Cigarette smoke consists of nonvolatile and volatile components. Nonvolatile components are removed in the fibrous filter primarily by diffusion, interception, and impaction. This mechanical filtration is believed to be nonreversible, that is, a smoke particle which collides with the filter material will not rebound and re-enter the smoke stream. Volatile smoke components are removed primarily by adsorption, absorption, and chemical reaction. Filtration of volatile smoke components by adsorption and absorption is reversible, that is, the volatile components that condense on the filter surface can revaporize and re-enter the smoke stream.

Nicotine in cigarette smoke is a semi-volatile component, which means this smoke component is distributed between the volatile and the nonvolatile phase. It is believed that the nonvolatile portion of the nicotine in cigarette smoke constitutes generally between about 75% and about 90%, and the volatile portion about 10% to about 25%. The distribution in nicotine depends on the blend of tobacco, crop, and smoking conditions. Since the nonvolatile portion of smoke is removed primarily by mechanical filtration, there is no selective filtration of the nonvolatile portion of nicotine. However, the volatile portion of nicotine may be selectively removed.

Previous methods for removing certain smoke components such as hydrogen cyanide and nicotine with filter additives utilized spraying or dusting the additives on fibrous filter material. With these application methods, the particle size of the additives are generally large compared to the size of the fiber constituting the filter material. Therefore, it is believed that the improvement of removal efficiencies of particulate matter and other smoke components are somewhat limited in the prior art because of the limitations in effective surface area generated by the prior art additives. While it is not desired to be bound by any particular theory or mechanism, it is believed that the improved results of the tobacco smoke filter material of the present invention is at least partially due to increased surface area. Increase of tar filtration from tobacco smoke while suppressing the nicotine filtration is substantially higher for the tobacco smoke filter material of the present invention than that of filters treated by prior art techniques. Preferably the tar filtration efficiency achieved is greater than about 5% absolute relative to a control without micro acicular crystals of a water soluble compound. More preferred is greater than 10 percent absolute and most preferred is greater than about 20 percent absolute.

It is also believed that covering the filter element surfaces with micro acicular crystals of an alkaline compound reduces the chance of forming a salt with nicotine on the surfaces and also increases the elution of nicotine to the smoke stream. The tobacco smoke filter material of the present invention increases the tar filtration efficiency substantially higher than conventional filters. For these reasons, the nicotine to tar delivery ratio of the smoke will be increased by use of the tobacco smoke filter material of this invention.

Typically, use of the tobacco smoke filter material of the present invention increases the nicotine/tar delivery of a filter cigarette at least about 20%, preferably at least about 30%, and most preferably at least about 40%, relative to a control filter cigarette using the same filter material except for the absence of the micro aricular crystals.

In addition to containing the compound capable of forming acicular crystals, the liquid solution can also contain minor amounts of other additives, e.g., up to about 5 weight %, preferably up to about 1 weight %, based on the weight of the filter material. Such additional additives can be, for example, to facilitate or increase adherence of the crystals on the surfaces. A preferred additional additive is sodium carboxymethyl cellulose. In the process of the present invention it is optionally preferred to remove excess solution from the filter element prior to performing step (c). This can be conveniently accomplished by contacting the filter element containing residual solution (preferably as crimped tow) with absorption paper, preferably the contacting occurs with slight pressure; or by running said filter element through a set of two or more parallel squeeze rolls.

The temperature of the process of the present invention is not known to be critical, especially for steps (a) and (b). Room temperature is preferred for convenience, but a temperature range of between the freezing point and boiling point of the applied solution is possible. Typically, such a temperature range will include a range of about 5°-35° C.

To perform step (c), the removal of water is preferably performed by simple drying. Step (c) is thus preferably performed at a temperature of about 0° to about 90° C. with about 10° to about 60° C. being more preferred. The time required for performing the process of the present invention is not critical as long as the desired micro acicular crystals are formed. For steps (a) and (b), the time involved will usually be dependent upon factors such as convenience and economics. Typically, for cellulose acetate tow, the time of immersion in solution will be about 1 or 2 minutes or longer. For step (c) the time required will be less if drying at a higher temperature is employed. For example, drying cellulose acetate crimped tow at a temperature of about 10° to about 60° C. will typically require at least about 10 minuts for formulation of the desired crystals; preferably about 10 minutes to about 5 days.

The following examples are to illustrate the invention but should not be interpreted as a limitation thereon.

EXAMPLES

Example 1

Three feet of crimped tow of 3.9 denier per filament cellulose acetate fibers (10,250 filaments) was opened and immersed in 20% water solution of sodium carbonate for about 1 minute, then placed on an absorption paper. Excess moisture was removed by pressing the tow with a paper towel. After drying the tow at room temperature, it was re-bloomed then pulled through a plastic straw to make filter rods. The rods were cut into 21 mm filters, then the filters were attached to 63 mm domestic cigarette tobacco columns to make 84 mm cigarettes. The amounts of tar and nicotine removed by the filters were determined by the FTC method which is the standard method used in the cigarette industry. The results are shown in Table I.

TABLE I

Cellulose Acetate Filters Containing Sodium Carbonate

| % Sodium Carbonate Content | Filter Pressure Drop (mm) | % Tar Removed By Filter |
|---|---|---|
| 10 | 97.9 | 53.3 |
| **% Nicotine Removed by Filter** | **Nicotine/ Tar Delivery Ratio** | **Percent Increase** |
| 40.5 | 0.0851 | 31* |

*Percent increase compared to the N/T ratio (0.0650) of normal or control filter cigarette, i.e., wherein the cellulose acetate fibers used to make the filter were not immersed in a sodium carbonate solution.

Example 2

Another set of samples were prepared with the same procedure described in Example 1. A few sample tows were also prepared by dipping the tow in 5% solution of sodium carbonate. A minute amount of sodium carboxymethyl cellulose (CMC) was added in the solution (i.e., <1 wt. %) of three samples to improve the adherence of crystals on the surface of the fiber. A control was also prepared wherein the tow used to make the filter was not dipped in a sodium carbonate solution. The smoke test results of these filters are shown in Table II.

TABLE II

Cellulose Acetate Filters Containing Sodium Carbonate

| % Sodium Carbonate Content | Filter Pressure Drop (mm) | % Tar Removed By Filter | % Nicotine Removed by Filter | Nicotine/ Tar Delivery Ratio | Percent Increase |
|---|---|---|---|---|---|
| | | A. Sample tows dipped in 20% solution | | | |
| 18.0* | 98.7 | 63.8 | 47.1 | 0.0938 | 41 |
| 11.6 | 93.7 | 64.3 | 47.4 | 0.0937 | 41 |
| | | B. Sample tows dipped in 5% solution | | | |
| 7.3* | 77.3 | 45.7 | 32.5 | 0.0793 | 19 |
| 9.1* | 80.4 | 47.6 | 30.3 | 0.0827 | 24 |
| 5.1 | 80.4 | 42.9 | 28.7 | 0.0776 | 17 |
| (control) | 61.8 | 32.9 | 28.2 | 0.0690 | |

*Samples prepared with CMC added in the solution.

The invention has been described in detail with particular reference to preferred embodiments thereof, but it will be understood that variations and modifications can be effected within the spirit and scope of the invention.

We claim:

1. A tobacco smoke filter material comprising a fibrous or sheet tobacco smoke filter element having surfaces for exposure to tobacco smoke, wherein said filter element has micro acicular crystals of a compound present on said surfaces in an amount of at least about 1 weight percent based on the weight of said filter material.

2. The tobacco smoke filter material of claim 1 wherein said compound is a non-toxic, water soluble, inorganic salt having a molecular weight of less than 1,000.

3. The tobacco smoke filter material of claim 2 wherein said compound is an inorganic phsophate or carbonate salt.

4. The tobacco smoke filter material of claim 2 wherein said compound is an alkali metal salt or an alkaline earth metal salt of an inorganic acid.

5. The tobacco smoke filter material of claim 4 wherein said compound is an alkali metal salt of an inorganic acid.

6. The tobacco smoke filter material of claim 1 wherein said compound is magnesium sulfate, ammonium phosphate (monobasic) or sodium carbonate.

7. The tobacco smoke filter material of claim 1 wherein said micro acicular crystals have an average length of between about 0.2 and about 20 μm and an average width of between about 0.1 and about 5 μm.

8. The tobacco smoke filter material of claim 1 wherein said micro acicular crystals have an average length of between about 0.5 and about 15 μm and an average width of between about 0.1 and about 3 μm.

9. The tobacco smoke filter material of claim 1 wherein the amount of micro acicular crystals is between about 1 and about 50 weight percent.

10. The tobacco smoke filter material. of claim 1 wherein the amount of micro acicular crystals is between about 5 and about 30 weight percent.

11. The tobacco smoke filter material of claim 1 wherein said filter element is comprised of cellulose acetate, regenerated cellulose, polyolefins, cotton, or paper.

12. The tobacco smoke filter material of claim 1 wherein said filter element is comprised of cellulose acetate.

13. The tobacco smoke filter material of claim 1 wherein a filter cigarette comprising said tobacco smoke filter material has a sufficient amount of micro acicular crystals present on the filter material to produce greater than about 10 percent absolute increased tar filtration efficiency relative to a comparable filter cigarette not having micro acicular crystals present in the filter.

14. A tobacco smoke filter material comprising a fibrous or sheet tobacco smoke filter element having surfaces for exposure to tobacco smoke, wherein said filter element has micro acicular crystals of sodium carbonate present on said surfaces in an amount of at least 1 weight percent based on the weight of said filter materials.

15. A tobacco smoke filter material comprising crimped fibrous cellulose acetate tow wherein said tow has surfaces for exposured to tobacco smoke, and said tow has between about 5 and about 20 weight percent of micro acicular crystals of sodium carbonate present on said surfaces, said percentages being based on the weight of said filter material, and wherein said micro acicular crystals have a length of between about 5 and about 15 μm and a width of between about 0.1 and about 3 μm and wherein a filter cigarette comprising said tobacco smoke filter material has greater than about 20 percent increased nicotine to tar ratio relative to a comparable filter cigarette not having said micro acicular crystals present in the filter.

* * * * *